US007946579B2

(12) United States Patent
Takenaka

(10) Patent No.: US 7,946,579 B2
(45) Date of Patent: May 24, 2011

(54) IMAGE FORMING APPARATUS, RECORDING MEDIUM CONVEYANCE CONTROL METHOD, AND COMPUTER PROGRAM PRODUCT THEREOF

(75) Inventor: Ryo Takenaka, Kanagawa (JP)

(73) Assignee: Ricoh Company. Ltd., Tokyo (JP)

( * ) Notice: Subject to any disclaimer, the term of this patent is extended or adjusted under 35 U.S.C. 154(b) by 253 days.

(21) Appl. No.: 11/979,495

(22) Filed: Nov. 5, 2007

(65) Prior Publication Data

US 2008/0106030 A1 May 8, 2008

(30) Foreign Application Priority Data

Nov. 6, 2006 (JP) ..... 2006-299842

(51) Int. Cl.
*B65H 7/02* (2006.01)

(52) U.S. Cl. ..... 271/266; 271/270

(58) Field of Classification Search ..... 271/266, 271/265.02, 270

See application file for complete search history.

(56) References Cited

U.S. PATENT DOCUMENTS 5,072,924 A * 12/1991 Sugiyama ..... 271/110
6,533,263 B2 * 3/2003 Tamura ..... 271/10.01
6,651,980 B2 * 11/2003 Isemura et al. ..... 271/259
6,757,515 B2 * 6/2004 Ueda ..... 399/396
7,004,464 B2 * 2/2006 Hattori et al. ..... 271/258.03
7,068,969 B2 * 6/2006 Ueda ..... 399/388
7,150,455 B2 * 12/2006 Furukawa et al. ..... 271/270
7,448,622 B2 * 11/2008 Kim ..... 271/265.01

FOREIGN PATENT DOCUMENTS

JP 02924203 5/1999
JP 2002-370849 12/2002
JP 2003-176045 6/2003
JP 2004-315177 11/2004

* cited by examiner

*Primary Examiner* — Kaitlin S Joerger
(74) *Attorney, Agent, or Firm* — Harness, Dickey & Pierce, P.L.C.

(57) ABSTRACT

An image forming apparatus that effectively reduces sheet collision and increases productivity includes a storage unit to store sheets of a recording medium, a feeder to feed the sheets one by one from the storage unit, a conveyance device to convey the sheets along a conveyance path, a plurality of sensors to detect the sheets, a registration device to perform registration to the sheets, and a controller to control the feeder, the conveyance device, and the registration device. When a first sheet is stopped at or before it reaches the registration device, the feeder feeds a second sheet to the conveyance path, while the controller checks an interval between the first and second sheets. The controller stops the second sheet when the interval is shorter than a given interval and conveys the second sheet to the registration device without stopping when the interval is not shorter than the given interval.

20 Claims, 15 Drawing Sheets

| |
|---|
| FIG. 11A |
| FIG. 11B |
| FIG. 11C |
| FIG. 11D |

IMAGE FORMING APPARATUS, RECORDING MEDIUM CONVEYANCE CONTROL METHOD, AND COMPUTER PROGRAM PRODUCT THEREOF

PRIORITY STATEMENT

The present patent application claims priority under 35 U.S.C. §119 from Japanese Patent Application No. 2006-299842, filed in the Japan Patent Office on Nov. 6, 2006, the content and disclosure of which are hereby incorporated by reference herein in their entirety.

BACKGROUND OF THE INVENTION

1. Field of the Invention

The present disclosure generally relates to an image forming apparatus in which a plurality of recording media are continuously conveyed, for example, printers, facsimiles, copiers, and multifunctional machines including functions of printer, facsimile, and copier, and also relates to a recording medium conveyance control method, and computer program product thereof.

2. Discussion of the Related Art

A conventional image forming apparatus includes a sheet storage part, a sheet feed and conveyance part, a registration part, an image formation part, and a sheet ejecting part. In the registration part, a sheet serving as a recording medium is corrected in its conveyance direction when the sheet is pushed into a nip between a pair of registration rollers with the registration rollers stopped. Thus, conveyance of the sheet is stopped once while its conveyance direction is corrected, after which conveyance is restarted at image transfer at a downstream position for accurate positioning of the image on the sheet. The sheet feeding and conveyance part continuously feeds sheets from the sheet storage part without waiting for image formation on the fed sheet for increasing a number of output sheets per unit of time.

In one example of a conventional image forming apparatus, to prevent a following sheet from catching up with the sheet stopped at the registration part, conveyance of the following sheet is stopped when the preceding sheet is stopped at the registration part. The conveyance of the following sheet is then restarted when conveyance of the sheet at the registration part is restarted.

At the same time, there is a continuing demand for increased productivity, which in turn necessitates that an interval between continuously fed sheets fed to the image formation part needs to be shortened.

Accordingly, in another example of a conventional image forming apparatus, in an effort to shorten the interval between continuously fed sheets, the following sheet is conveyed at a faster speed than the preceding sheet during a given time, thus shortening the interval between the preceding sheet and the following sheet and improving productivity.

The interval between the preceding sheet and the following sheet may be shortened still more effectively when the following sheet is conveyed while the preceding sheet is stopped at the registration part.

SUMMARY OF THE INVENTION

An embodiment of the present invention is directed to an image forming apparatus, a recording medium conveyance control method, and a computer program product thereof. The image forming apparatus, the recording medium conveyance control method, and the computer program product thereof effectively reduce sheet collision and thereby increase productivity.

The image forming apparatus includes a storage unit configured to store sheets of a recording medium, a feeder configured to feed the sheets one by one from the storage, a conveyance device configured to convey the sheets along a conveyance path, a plurality of sensors configured to detect the sheets, a registration device configured to perform registration to the sheets of the recording medium, and a controller configured to control the feeder, the conveyance device, and the registration device such that, when a first sheet is stopped at the registration device or before the first sheet reaches the registration device, the feeder feeds a second sheet to the conveyance path while the controller checks an interval between the first sheet and the second sheet. The controller stops the second sheet on the conveyance path when the interval is shorter than a given interval, and conveys the second sheet to the registration device without stopping when the interval is not shorter than the given interval.

The recording medium conveyance control method includes the steps of feeding sheets of a recording medium one by one, conveying the sheets of the recording medium to a registration device along a conveyance path, feeding a second sheet of the recording medium to the conveyance path when a first sheet of the recording medium is stopped at the registration device or before the first sheet reaches the registration device while checking an interval between the first sheet of the recording medium and the second sheet of the recording medium, and stopping the second sheet of the recording medium on the conveyance path when the interval is shorter than a given interval, and conveying the second sheet of the recording medium to the registration device without stopping when the interval is not shorter than the given interval.

A computer program product for a recording medium conveyance control method causes a computer to execute the recording medium conveyance control method described above.

Additional features and advantages of the present invention will be more fully apparent from the following detailed description of embodiments, the accompanying drawings, and the appended claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
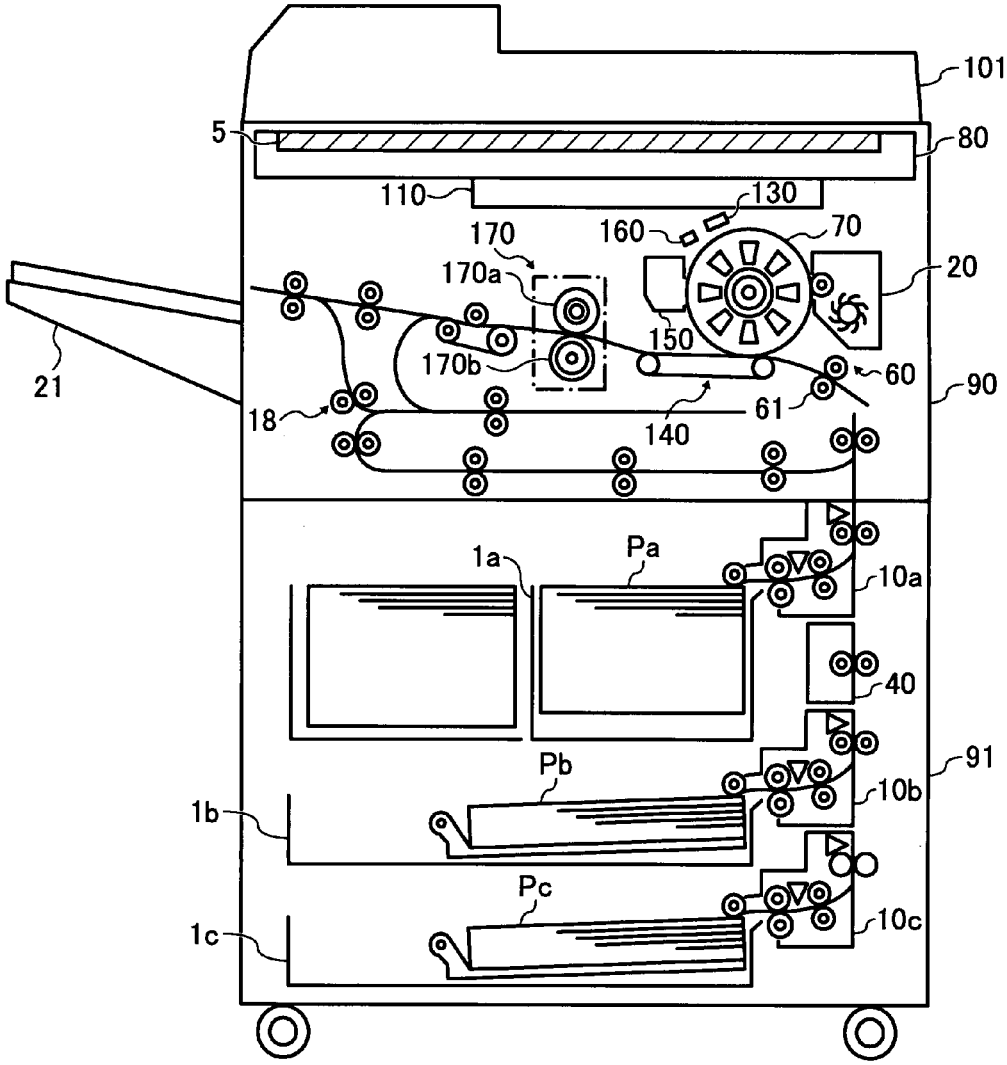
FIG. 1 is a perspective diagram showing a configuration of an image forming apparatus according to an embodiment of the present invention.

Referring now to the drawings, wherein like reference numerals designate identical or corresponding parts throughout the several views, embodiments of the present disclosure, which are applied to an electrophotographic image forming apparatus, are described below.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Figure 4:
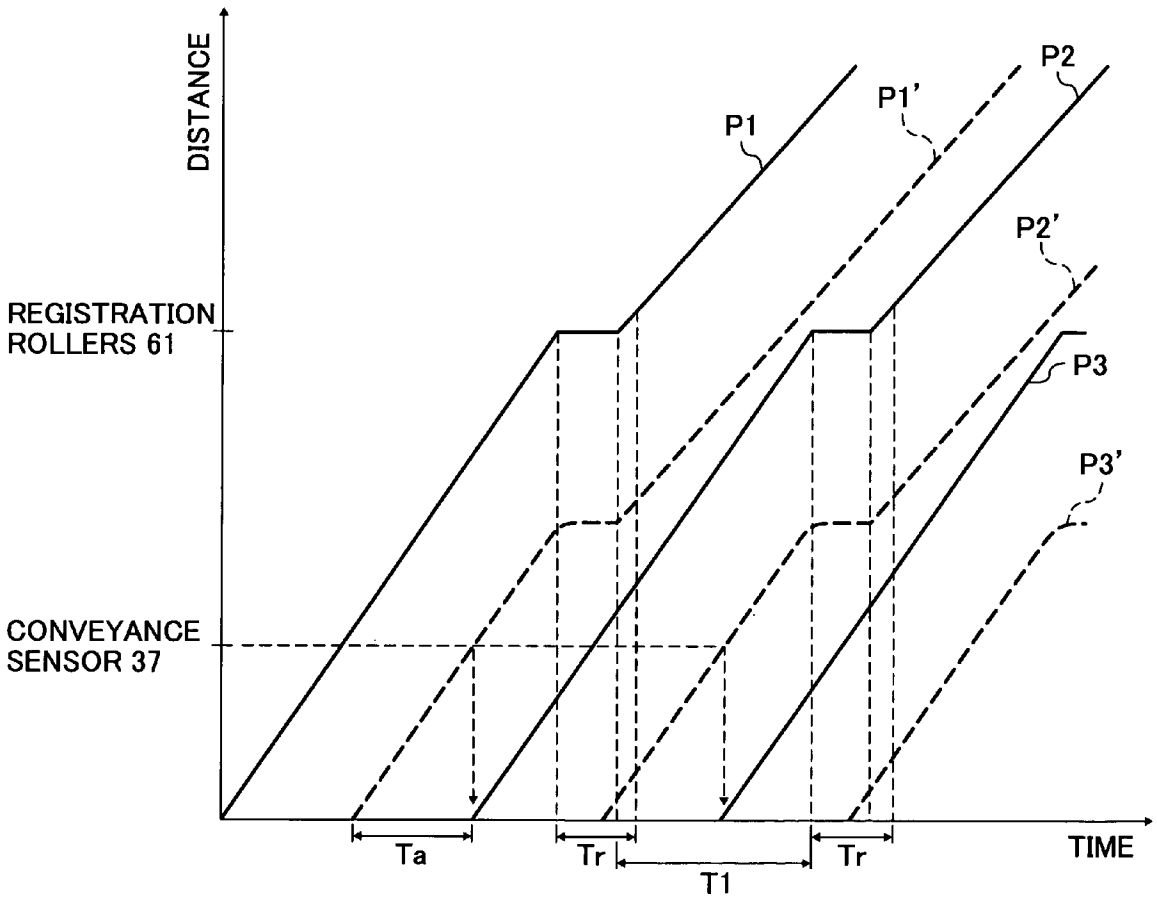
FIG. 4 is a timing chart of control of a registration part of the image forming apparatus according to an embodiment of the present invention.

Referring now to the drawings, particularly to FIG. 4, an example of a timing chart illustrating control of the registration part of an image forming apparatus according to embodiments is described.

First Embodiment

FIG. 1 is a perspective diagram showing a configuration of an electrophotographic copying machine as an image forming apparatus according to an embodiment of the present invention. The copying machine includes a scanner 80, an automatic document feeder 101, a printing part 90, and a sheet feed and conveyance part 91.

The automatic document feeder 101 automatically feeds document objects (not shown) from an upper side position to an upper side of a contact glass 5.

The scanner 80 is for reading a pictorial image of the document objects (not shown). When an operator operates a start button with the document objects set on the contact glass 5 on the scanner 80, an image scanning operation immediately starts. When an operator operates the start button with the document objects set on the automatic document feeder 101, an image scanning operation starts after automatically feeding the document object to the upper side of the contact glass 5.

The printing part 90 is for forming a toner image on a sheet P, which includes an optical writing unit 110 and a photoconductor 70. The printing part 90 includes an electrostatic charger 130, a development unit 20, a transfer and conveyance unit 140, a drum cleaning unit 150, and a neutralization device 160 around the photoconductor 70. The printing part 90 includes a fixing unit 170, a reversing sheet ejection unit 18, and a pair of registration rollers 61. When an operator operates the start button, the photoconductor 70 is rotated by a driver, not shown.

The optical writing unit 110 modulates the laser beam, based on the image signal read with the scanner 80. The optical writing unit 110 exposes the drum-like photoconductor 70 and forms an electrostatic latent image in the top layer of the photoconductor 70.

The transfer and conveyance unit 140 includes an endless transfer conveyance belt stretched across tension rollers. The transfer conveyance belt contacts the photoconductor 70 to form a transfer nip-region between them. A transfer bias roller contacts an inner loop side surface of the transfer conveyance belt at the position of the transfer nip region. A power supply (not shown) applies a transfer bias to the transfer bias roller to form a transfer electrical field in the transfer nip region.

The optical writing unit 110 forms a latent image on the photoconductor 70 by exposure. The latent image is developed with the development unit 20 to form a toner image. The toner image is conveyed to the transfer nip region. The registration rollers 61 pinch the sheet P from a sheet feed and conveyance part 91 after the operation of the start button. The sheet P is conveyed at the same time the toner image on the photoconductor 70 is transferred onto the sheet P in the transfer nip region. The toner image on the photoconductor 70 may contact the sheet P closely by this conveyance. The toner image on the photoconductor 70 may be transferred onto the surface of the sheet P by the transfer electrical field under influence of a nip pressure. After transfer, the sheet P is conveyed to the fixing unit 170 with the transfer conveyance belt. In the fixing unit 170, the sheet P is conveyed between a heat roller 170*a* and a press roller 170*b*. The toner image on the sheet P is fixed in place by heat and pressure, after which the sheet P is conveyed to the reversing sheet ejection unit 18.

The reversing sheet ejection unit 18 ejects the conveyed sheet P to an ejection sheet tray 21. If a double-sided copy mode is selected, the sheet P is reversed in the reversing sheet ejection unit 18 and conveyed to the pair of registration rollers 61. The sheet P is conveyed to the transfer nip region again through the pair of registration rollers 61, and a toner image is transferred onto a reverse side of the sheet P, which is on a side opposite that of the previous transfer.

The drum cleaning unit 150 cleans waste toner on the surface of the photoconductor 70 that has passed the transfer nip region. After the cleaning process, the charge on the surface of the photoconductor 70 is removed by the neutralization device 160. After that, the charger 130 charges the surface of the photoconductor 70 in preparation for a succeeding image formation.

Next, a detailed description is given of the sheet feed and conveyance part 91 of the present invention. The sheet feed and conveyance part 91 is located at an extreme upstream position of the sheet conveyance. A sheet feed tray 1*a*, a sheet feed tray 1*b*, and a sheet feed tray 1*c*, and a sheet feeding unit 10*a*, a sheet feeding unit 10*b*, and a sheet feeding unit 10*c*, respectively, are located at a lower position of the image forming apparatus. A top of piled sheets Pa, Pb, and Pc on the sheet feed trays 1*a*, 1*b*, and 1*c*, respectively, is fed one by one. The sheet feed tray 1*a* is a high-capacity tray. The sheet feed tray 1*b* has same configuration as the sheet feed tray 1*c*. The sheet feeding unit 10*a*, the sheet feeding unit 10*b*, and the sheet feeding unit 10*c* have the same configuration. A relay unit 40 is located between the sheet feeding unit 10*a* and the sheet feeding unit 10*b*. A sheet P fed by one of the sheet feeding units passes along a sheet conveyance path through the sheet feeding units 10*a*, 10*b*, and 10*c*, and the relay unit 40. A registration part 60 is located at an extreme downstream position of the sheet conveyance path. Registration of the sheet is carried out at the registration part 60, and the sheet is conveyed so that the image on the photoconductor 70 may be correctly positioned on the sheet. Thus, the sheet is conveyed to an image formation part.

Figure 2:
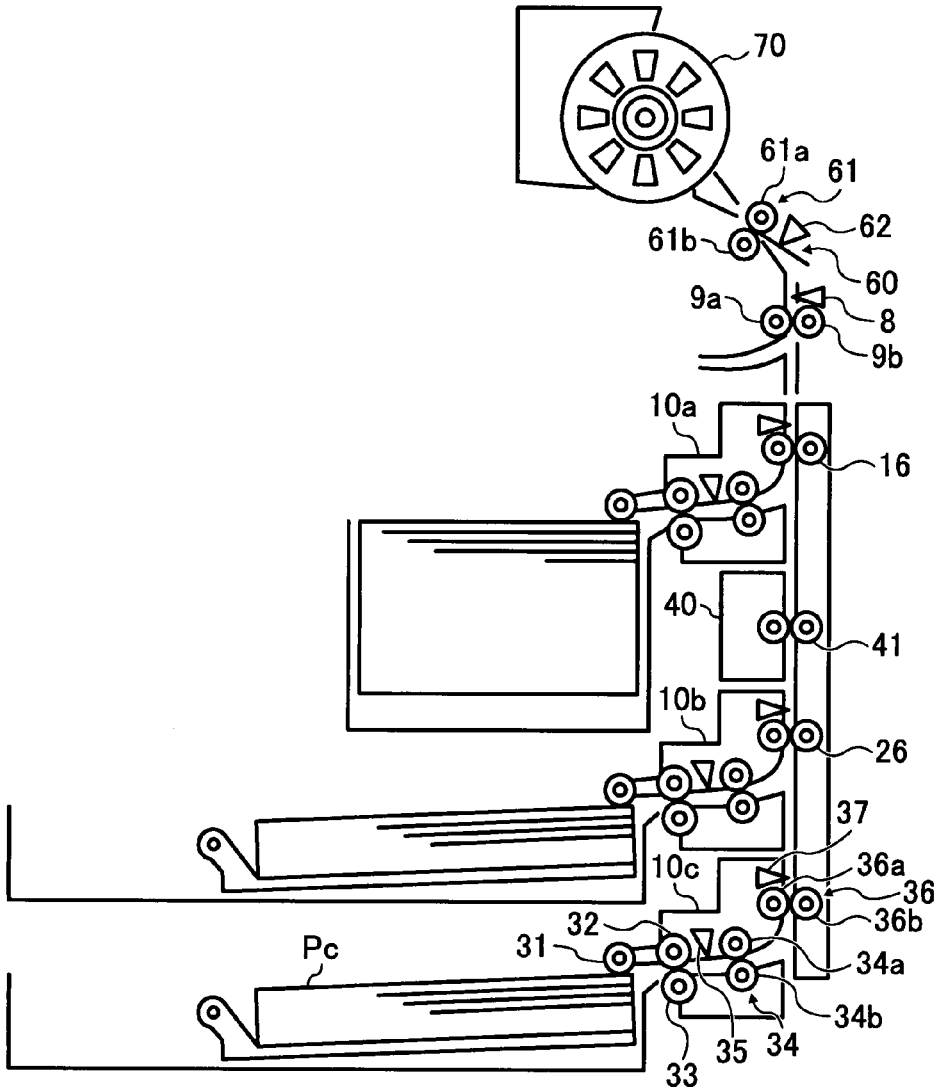
FIG. 2 is a cross-sectional diagram showing a configuration of a sheet feed and conveyance part of the image forming apparatus of FIG. 1.

FIG. 2 is a cross-sectional diagram showing a configuration of a sheet feed and conveyance part of the image forming apparatus of FIG. 1. In FIG. 2, the sheet feeding unit 10*c* includes a pickup roller 31, a feed roller 32, a reverse roller 33, a first pair of grip rollers 34, a sheet feed sensor 35, a second pair of grip rollers 36, and a conveyance sensor 37. The pickup roller 31 catches and sends out the top sheet of the piled sheets Pc. The feed roller 32 conveys the sheet sent from the pickup roller 31. The reverse roller 33 rotates so that only one sheet may be conveyed at a time. The first pair of grip rollers 34 conveys the sheet fed from the feed roller 32. The sheet feed sensor 35 is located between the feed roller 32 and the first pair of grip rollers 34. The second pair of grip rollers 36 conveys the sheet from the first pair of grip rollers 34 so that the sheet is conveyed in a vertical direction. The conveyance sensor 37, which is located at a downstream position from the second pair of grip rollers 36, detects whether or not the sheet ejects from the sheet feeding unit 10*c*. The sheet feeding units 10*a*, 10*b*, and 10*c* in the sheet feed and conveyance part 91 have the same configuration.

The sheet conveyed from the sheet feeding unit 10*c* is conveyed by a second pair of grip rollers 26 in the sheet feeding unit 10*b*, a pair of conveyance rollers 41 in the relay unit 40, and a second pair of grip rollers 16 in the sheet feeding unit 10*a*, so that the sheet may reach the registration part 60. The registration part 60 includes a pair of registration rollers 61 and a registration sensor 62. The registration rollers 61 corrects a direction of sheets. The registration sensor 62 is used for controlling movement of the registration rollers 61. An intermediate roller 9*a* and an intermediate roller 9*b* are located between the registration part 60 and the sheet feeding unit 10*a* for conveying sheets. An intermediate sensor 8 is located between the registration part 60 and the sheet feeding unit 10*a* for detecting information for controlling the intermediate roller 9*a* and the intermediate roller 9*b*.

Figure 3:
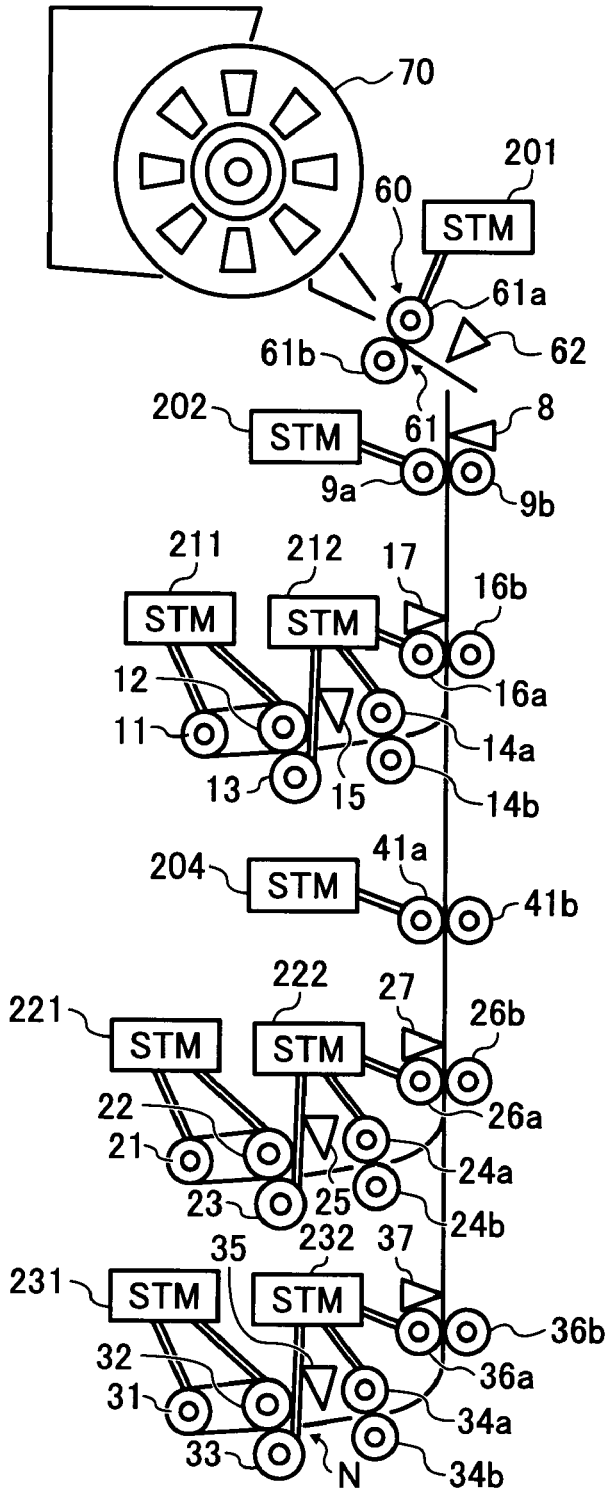
FIG. 3 is a cross-sectional diagram showing a configuration of conveying rollers and stepping motors in the sheet feed and conveyance part of the image forming apparatus of FIG. 1.

FIG. 3 is a cross-sectional diagram showing a configuration of conveying rollers and stepping motors in the sheet feed and conveyance part 91 of the image forming apparatus of FIG. 1. A configuration of conveying rollers and stepping motors in the sheet feeding unit 10*c* alone is described as representative of all three sheet feeding units 10*a*, 10*b*, and 10*c* because the sheet feeding units 10*a*, 10*b*, and 10*c* all have a similar configuration. The pickup roller 31 and the feed roller 32 are driven by a sheet feed stepping motor 231. The reverse roller 33, a first grip roller 34*a*, and a second grip roller 36*a* are driven by a sheet conveyance stepping motor 232. A first grip roller 34*b*, and a second grip roller 36*b* are rotated by pressing the first grip roller 34*a*, and the second grip roller 36*a*, respectively. A conveyance roller 41*a* is driven by a relay stepping motor 204 in the relay unit 40. A registration roller 61*a* is driven by a registration stepping motor 201. An intermediate roller 9*a* is driven by an intermediate stepping motor 202. A conveyance roller 41*b*, a registration roller 61*b*, and an intermediate roller 9*b* are rotated by pressing the conveyance roller 41*a*, the registration roller 61*a*, and the intermediate roller 9*a*, respectively.

Next, a feed and conveyance process in the sheet feed and conveyance part 91 is explained. The feed and conveyance process is continuously carried out in the following sequences. If the sheet is fed from the sheet feeding unit 10*c*, the pickup roller 31 catches and sends out the top sheet of the piled sheets Pc. The sheet is conveyed to a nip region N between the feed roller 32 and the reverse roller 33. When the pickup roller 31 catches and sends out one sheet, the reverse roller 33 rotates in a sheet conveying direction. If the pickup roller 31 catches and sends out a plurality of sheets, the reverse roller 33 rotates in a sheet conveying back direction until only one sheet is remained in the nip region N. When the end part of the sheet reaches a position of the sheet feed sensor 35, the pickup roller 31 separates from the piled sheets Pc for preventing multi-sheet feeding. The sheet is conveyed by the feed roller 32. Next, the sheet is conveyed by the first pair of grip rollers 34. Further, the sheet is conveyed by the second pair of grip rollers 36. When the end part of the sheet reaches a position of the conveyance sensor 37, the feed roller 32 is stopped. The sheet is conveyed by the first pair of grip rollers 34 and the second pair of grip rollers 36. Further, the sheet is conveyed through the positions of a second pair of grip rollers 26 of the sheet feeding unit 10*b*, a pair of relay rollers 41, a second pair of grip rollers 16 of the sheet feeding unit 10*a*, and the pair of intermediate rollers 9, and the sheet reaches a position of the registration sensor 62. The registration rollers 61 corrects the direction of the sheet. When a given time elapses after detecting the sheet with the registration sensor 62, all conveying rollers holding the sheet are stopped to make a wave in the sheet. When the written image meets the sheet, all conveying rollers holding the sheet and the registration rollers 61 convey the sheet again, so that the sheet is conveyed to the printing part 90. The sequence is finished when the sheet is conveyed from the sheet feed and conveyance part 91 to the printing part 90. To improve productivity, the following sheet starts conveyance before a previous sheet is conveyed to the printing part 90, and the sequence is repeated.

Example 1

A description is now given of feed and conveyance control in a first embodiment of the present invention.

FIG. 4 is a timing chart illustrating control of the registration part of an image forming apparatus according to an embodiment of the present invention, in which the sheet is conveyed from the sheet feed tray 1*c* in normal operation. A solid line P1 shows the leading end of the first sheet, and a dashed-line P1' shows the trailing end. The first sheet is conveyed to the pair of registration rollers 61 at a conveyance speed of Vf without stopping. After stopping a given time Tr at the registration part 60, conveyance is restarted and the sheet is conveyed to the image formation part at an image formation and conveyance speed of Vp. When the trailing end P1' of the first sheet passes the conveyance sensor 37, a feed P2 of the second sheet starts. The second sheet is conveyed to the pair of registration rollers 61 at a conveyance speed of Vf without stopping. While the second sheet is conveyed at the conveyance speed of Vf, the first sheet stops a given time Tr in the registration part 60, after which it is conveyed at the image formation and conveyance speed of Vp. Therefore, an interval between the first sheet and the second sheet is shortened, and productivity improves. After that, the same operation is repeated for a required number of sheets. In this case, productivity may be expressed as 60 (seconds)/(T1+Tr) (seconds), where T1 is time from re-conveyance of the first sheet from the registration part 60 to halting of the second sheet in the registration part 60. As mentioned above, the control chart shown in FIG. 1 applies only when the time the sheet stops in the registration part 60 is shorter than Tr.

Figure 5:
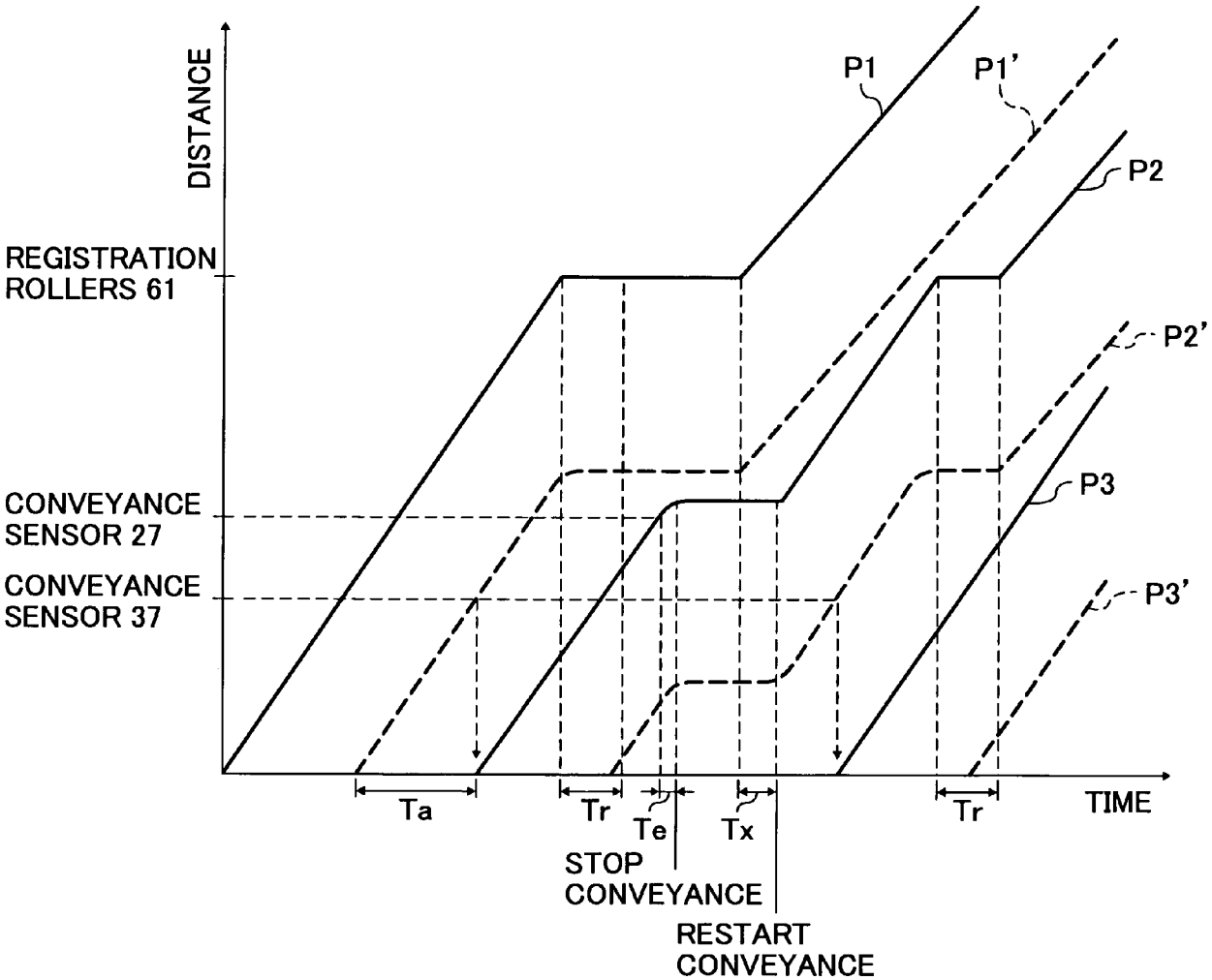
FIG. 5 is another timing chart of control of the registration part of the image forming apparatus according to an embodiment of the present invention.

FIG. 5 is another timing chart illustrating control of the registration part of an image forming apparatus according to an embodiment of the present invention, in which the stop time of the sheet in the registration part 60 is longer than Tr. The first sheet is conveyed to the pair of registration rollers 61 at a conveyance speed of Vf without stopping. The first sheet stays in the registration part 60 even when a given time Tr elapses. A CPU, not shown, which controls a main body of the image forming apparatus with an image formation program, recognizes the extending of the stop time of the sheet in the registration part 60, and stops conveyance of the second sheet at the position of a conveyance sensor 27 even though the conveyance of the second sheet from the sheet feed tray 1*c* is started before the CPU recognition of the extending of the stop time of the first sheet.

Figure 6:
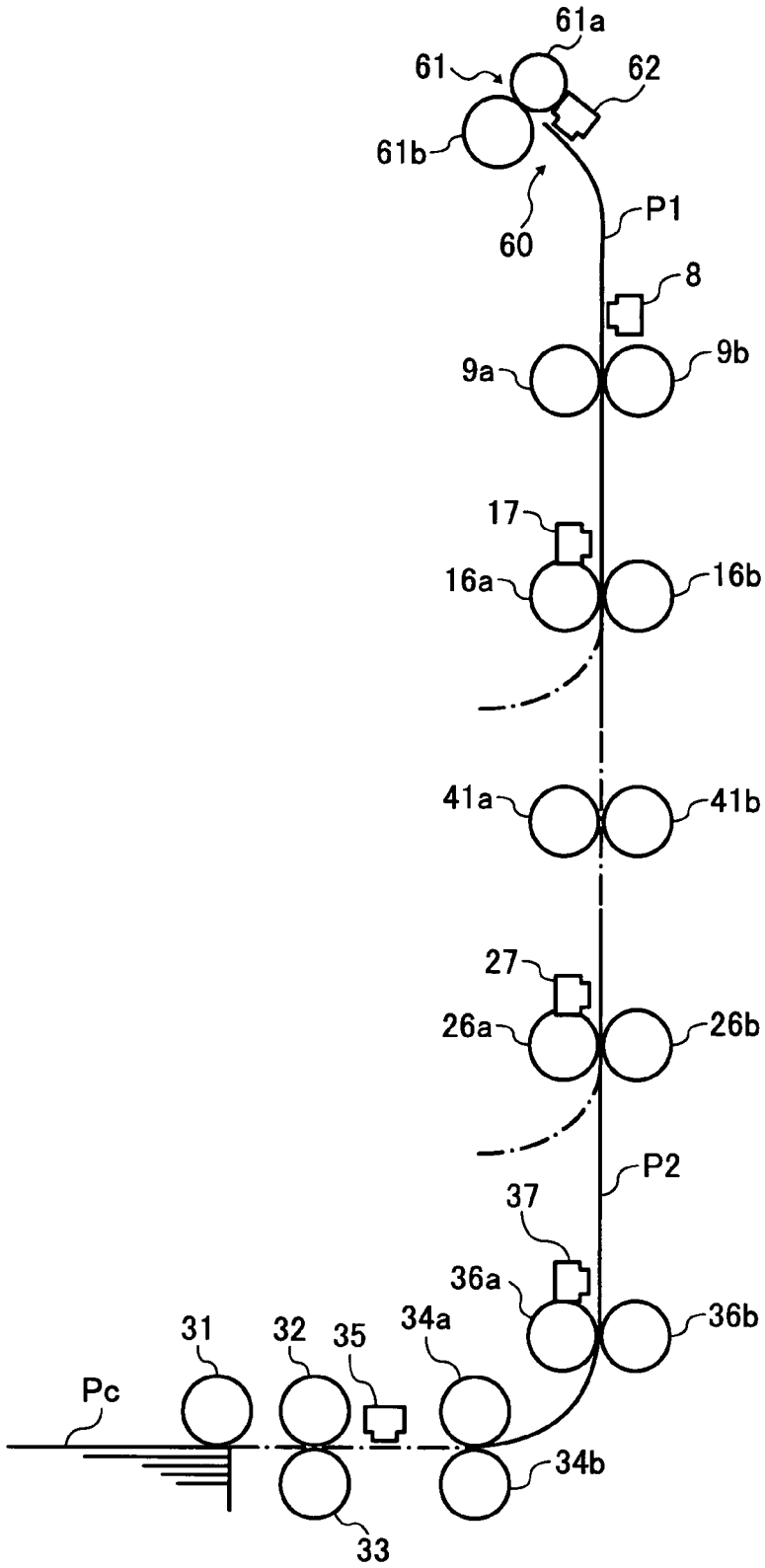
FIG. 6 is a cross-sectional diagram showing a configuration of the sheet feed and conveyance part of the image forming apparatus of FIG. 1.

FIG. 6 is a cross-sectional diagram showing a configuration of a sheet feed and conveyance part of the image forming apparatus of FIG. 1, illustrating the relation between the first sheet and the second sheet at this time. After that, the conveyance of the first sheet stopped at the registration part 60 is restarted. After a given time Tx, the conveyance of the stopped second sheet is restarted. Therefore, the second sheet is conveyed to the registration part 60 with the complete conveyance state from the registration part 60 in the first sheet, and the second sheet does not overtake the previous sheet. The leading end of the second sheet invades the registration roller pair 61 before a rotation operation of the registration roller pair 61 stops. Therefore, it may also be controlled that the leading end of the second sheet is sent out to the downstream side of the sheet conveyance from the registration roller pair 61. After the trailing end P1' of the first sheet is detected by the registration sensor 62, it is also possible for a given time to pass and conveyance of the second sheet to be resumed, after which there is a resumption of normal control. Although productivity with respect to conveyance of the first and the second sheet decreases temporarily due to the extending of the stop time of the first sheet in the registration part 60, normal control resumes after the second sheet (i.e., with a third sheet) and with it high productivity.

Every stepping motor in the image forming apparatus needs a rise time of about several tens of milliseconds to reach its target speed from an idle state. The stepping motors also need a fall time of about several tens of milliseconds to stop. However, so long as the stepping motors rotate correctly they do not get out of phase, and therefore, except for gear or pulley backlash, there is little variation in the amount of advance until the paper stops.

In the embodiment, each sensor in the main body is a photo-reflexive sensor. The photo-reflexive sensor is a sensor which combines a light emitting part and a euphotic part in a single unit. When there is no sheet in a sensor location, the light emitted from the light emitting part is emitted as is, and in the euphotic part, since incident light is not detected, it is detected as having no sheet. Conversely, when a sheet exists in the sensor location, the light emitted from the light emitting part is reflected by the sheet, and by detecting the reflected light in the euphotic part, it is detected as having a sheet. In addition, the photo-reflexive sensors have little physical detection delay. The above-described registration control procedure is carried out by conveyance control of an open loop using the stepping motors with detection information from the sensors. Therefore, the conveyance control easily minimizes irregular drops in productivity.

Figure 7:
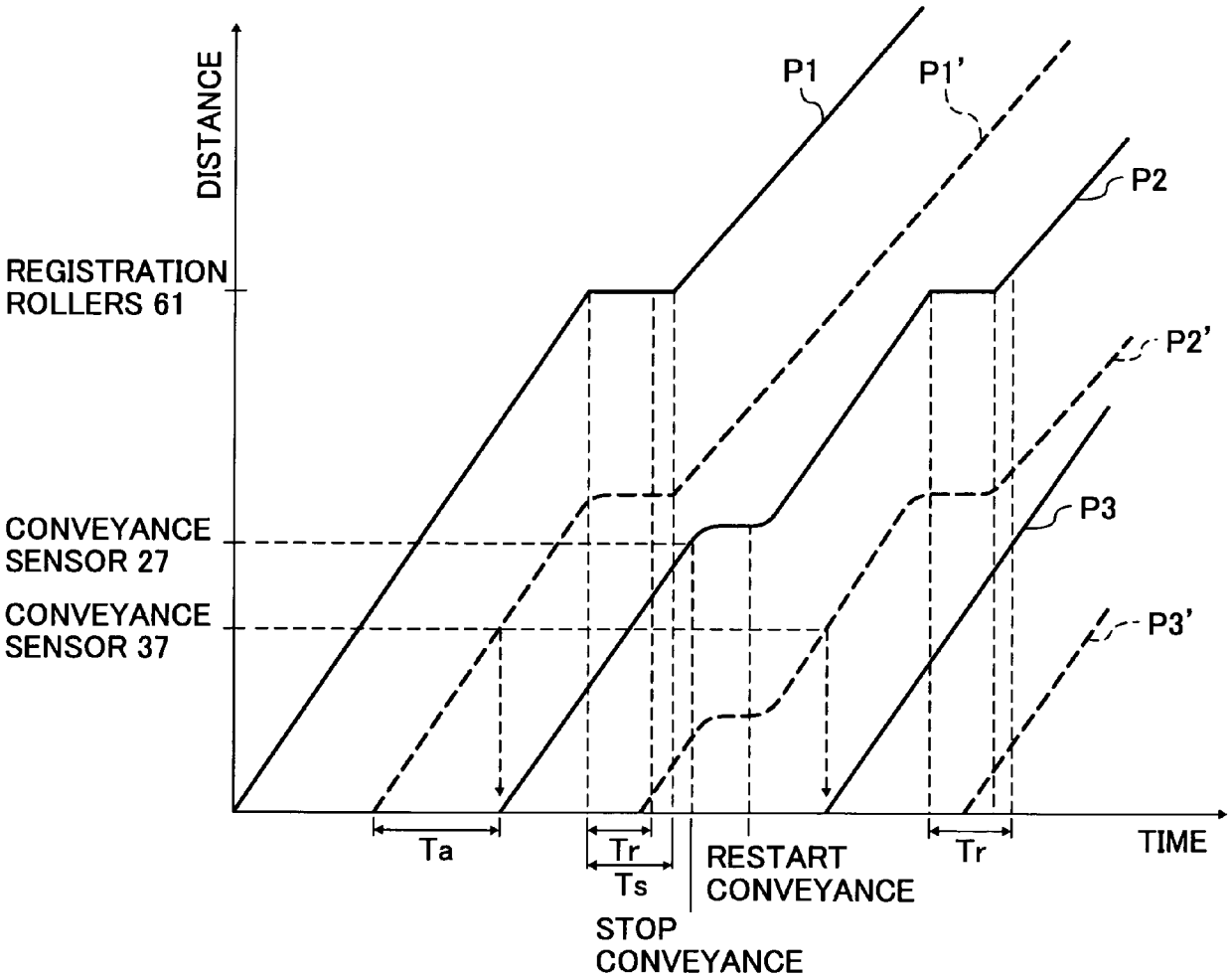
FIG. 7 is another timing chart of control of the registration part of the image forming apparatus according to an embodiment of the present invention.

Next, feed conveyance control performed by changing a resumption timing of conveyance of a following sheet according to the stop time in the registration part 60 is explained. FIG. 7 is another timing chart illustrating control of the registration part of an image forming apparatus according to an embodiment of the present invention. When the stop time of the first sheet in the registration part 60 is short (about 5 ms to 50 ms), the control procedure in FIG. 7 is carried out. The first sheet is conveyed to the pair of registration rollers 61 at a conveyance speed of Vf without stopping. The first sheet stops a given time Tr at the registration part 60. The CPU recognizes the extension of the stop time of the first sheet at the registration part 60, and the following control procedure is carried out. However, conveyance of the first sheet resumes before conveyance of the second sheet stops at the conveyance sensor 27. Therefore, resumption of the conveyance of the first sheet cannot trigger resumption of the conveyance of the second sheet after a given time Tx. The stop time of the first sheet in the registration part 60 is called Ts. When the expression Tf>Ts>Tr is true, where Tf is a given time, the conveyance of the second sheet is controlled to restart immediately after the stop of the second sheet under condition of operating ability of stepping motors 222 and 232 conveying the second sheet. This prevents conveyance delay of the second sheet and reduces a drop in productivity. Normal control resumes after the second sheet.

Productivity with respect to conveyance of the first and the second sheet decreases temporary due to the extending of the stop time of the first sheet in the registration part 60. However, normal control returns after the second sheet, as does conveyance with high productivity.

Example 2

Figure 8:
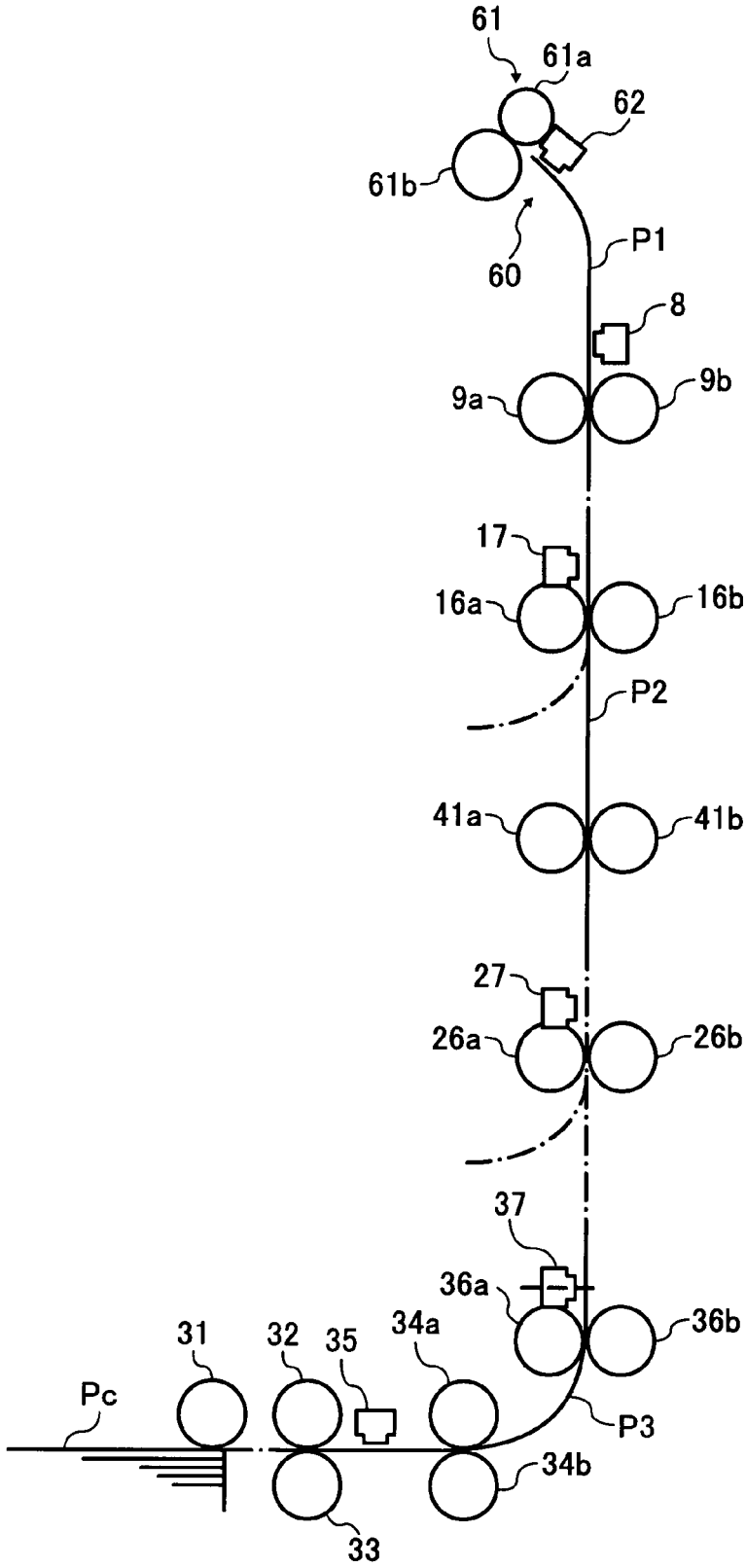
FIG. 8 is a cross-sectional diagram showing a configuration of the sheet feed and conveyance part of the image forming apparatus of FIG. 1.

FIG. 8 is a cross-sectional diagram showing a configuration of a sheet feed and conveyance part of the image forming apparatus of FIG. 1, illustrating the relation between the first sheet and the second sheet and the third sheet.

Figure 9:
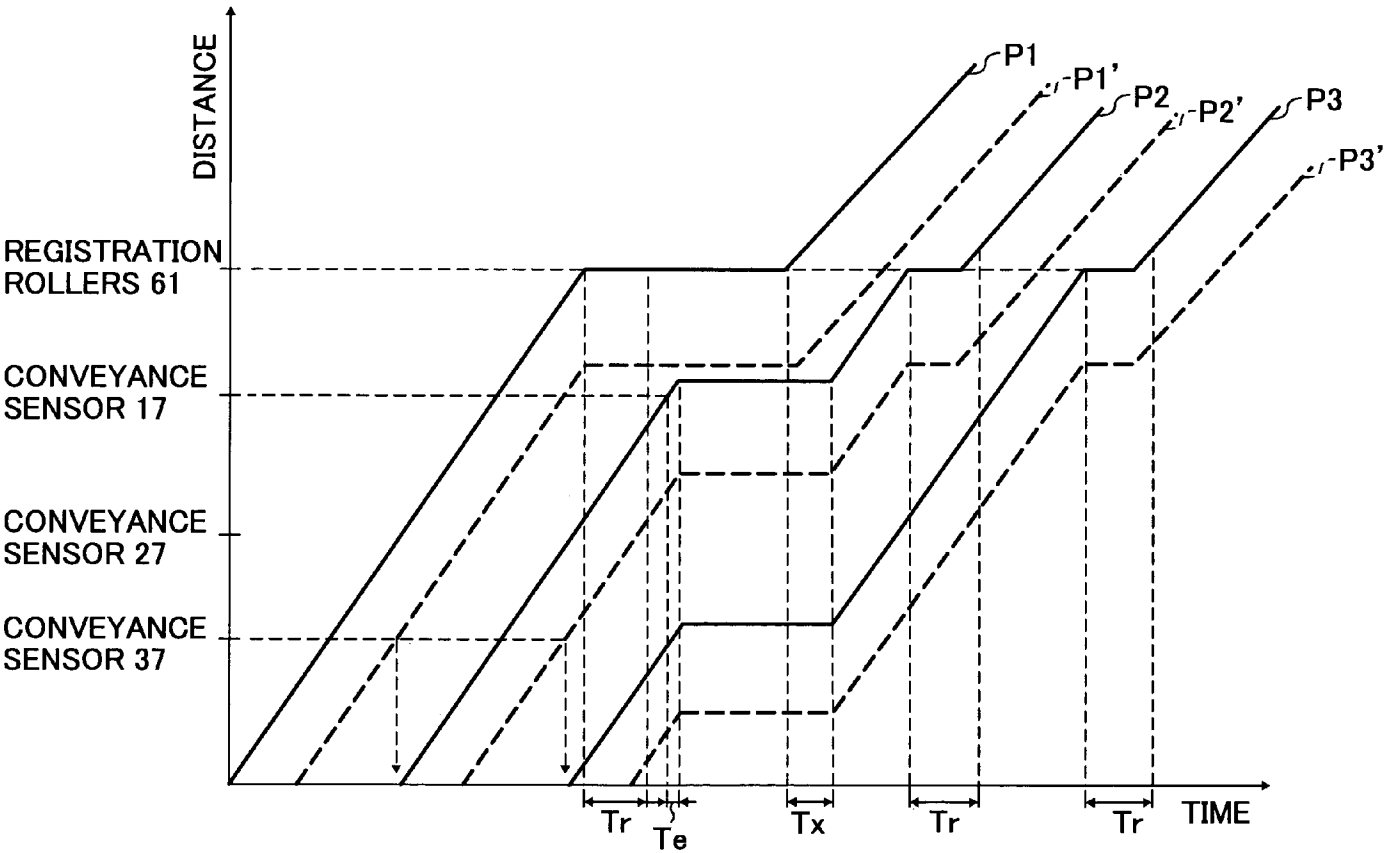
FIG. 9 is another timing chart of control of the registration part of the image forming apparatus according to an embodiment of the present invention.

FIG. 9 is another timing chart illustrating control of the registration part of an image forming apparatus according to an embodiment of the present invention. A solid line P1 shows the leading end of the first sheet, and a dashed-line P1' shows the trailing end. The first sheet is conveyed from the sheet feed tray 1*c* to the pair of registration rollers 61 without stopping. When the trailing end P1' of the first sheet passes the conveyance sensor 37, a feed P2 of the second sheet starts. When the trailing end P2' of the second sheet passes the conveyance sensor 37, a feed P3 of the third sheet starts. The CPU recognizes the extension of the stop time of the sheets at the registration part 60, and stops conveyance of the second sheet at the position of a conveyance sensor 27 even though the conveyance of the second and the third sheets from the sheet feed tray 1*c* is started before the CPU recognition of the extending of the stop time of the first sheet. The conveyance of the third sheet is stopped with the stopping of the second sheet. After that, the conveyance of the first sheet stopped at the registration part 60 is restarted. After a given time Tx, the conveyance of the stopped second and the third sheets is restarted. Hereinafter, the same operation is repeated for the required number of sheets.

Performing the above-described control procedure prevents the second sheet from overtaking the previous sheet. In addition, by stopping the third sheet when judging the second sheet to be stopped, the third sheet is prevented from overtaking the previous sheet without the need for complicated control.

Although in the present example a description is given of three sheets conveyed in sequence, the process is not essentially different when four or more sheets are conveyed in sequence, insofar as the third and subsequent sheets may be stopped with the stopping of the second sheet, thus preventing the above-described control procedure from becoming unduly complicated.

In addition, it should be noted that the restart timing of the conveyance of the second and the third sheet when the first sheet is conveyed with the pair of registration rollers 61 in the example 2 described above is not restricted to what is described above. As described in the example 1, when the extension of the stop time of the first sheet that is stopped at the pair of registration rollers 61 is short (about 5 ms to 50 ms), resumption of the conveyance of the second and the third sheet may be possible immediately after stopping the conveyance of the second and the third sheet in the operating range of stepping motors 204, 212, 222, and 232. When the extension of the stop time of the first sheet that is stopped at the pair of registration rollers 61 is longer than about 50 ms, the conveyance of the second and the third sheet may be restarted after the given time Tx. Alternatively, the conveyance of the second and the third sheet may be restarted a given time after the detection of the trailing end of the first sheet with the registration sensor 62. By changing the restart timing of the second and the third sheet according to the stop time of the first sheet at the pair of registration rollers 61, an excessive decrease in productivity is prevented.

Second Embodiment

In a second embodiment of the present invention, at a given time after the detection of the leading end of the following sheet with a specific conveyance sensor, a stop of the previous sheet at the pair of registration rollers 61 is detected. According to the results of that detection, a determination is made whether to continue or to halt sheet conveyance. For brevity, a description of the essential parts described in the first embodiment is omitted from the following description.

Example 3

Figure 10A:
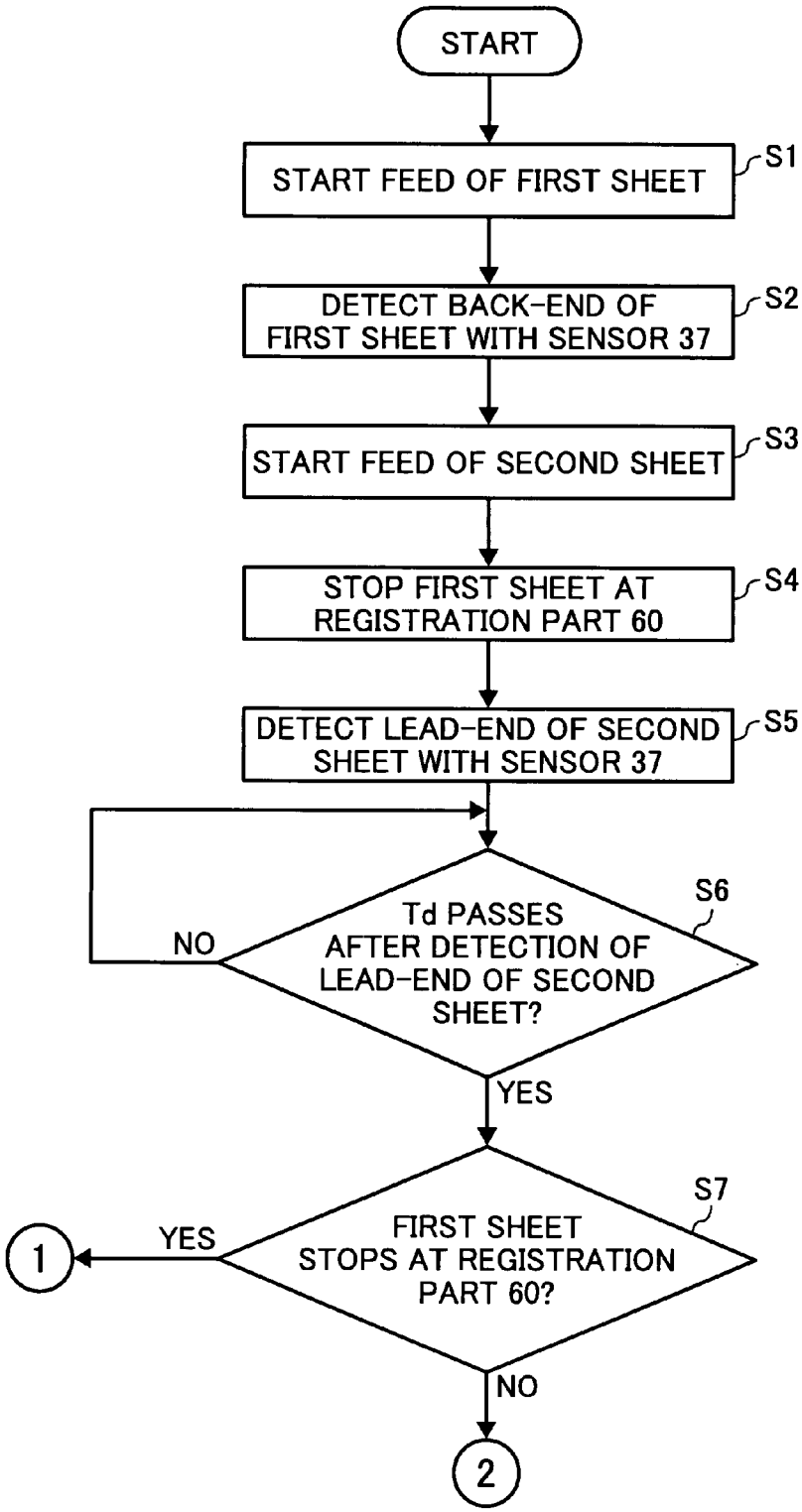
FIGS. 10A and 10B are a flowchart showing one example of a control procedure of the present invention.
Figure 10B:
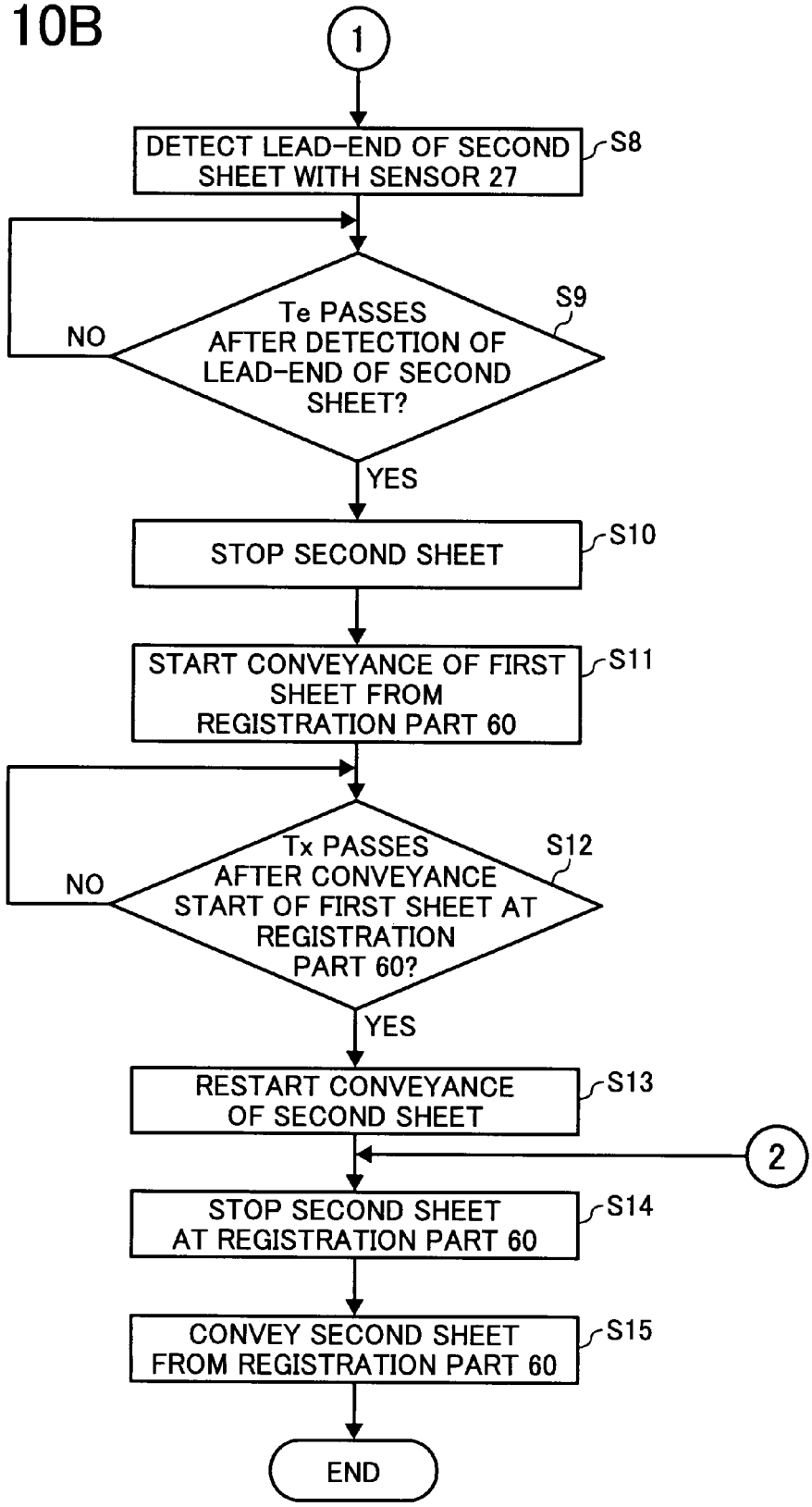
Figures 11, 11A:
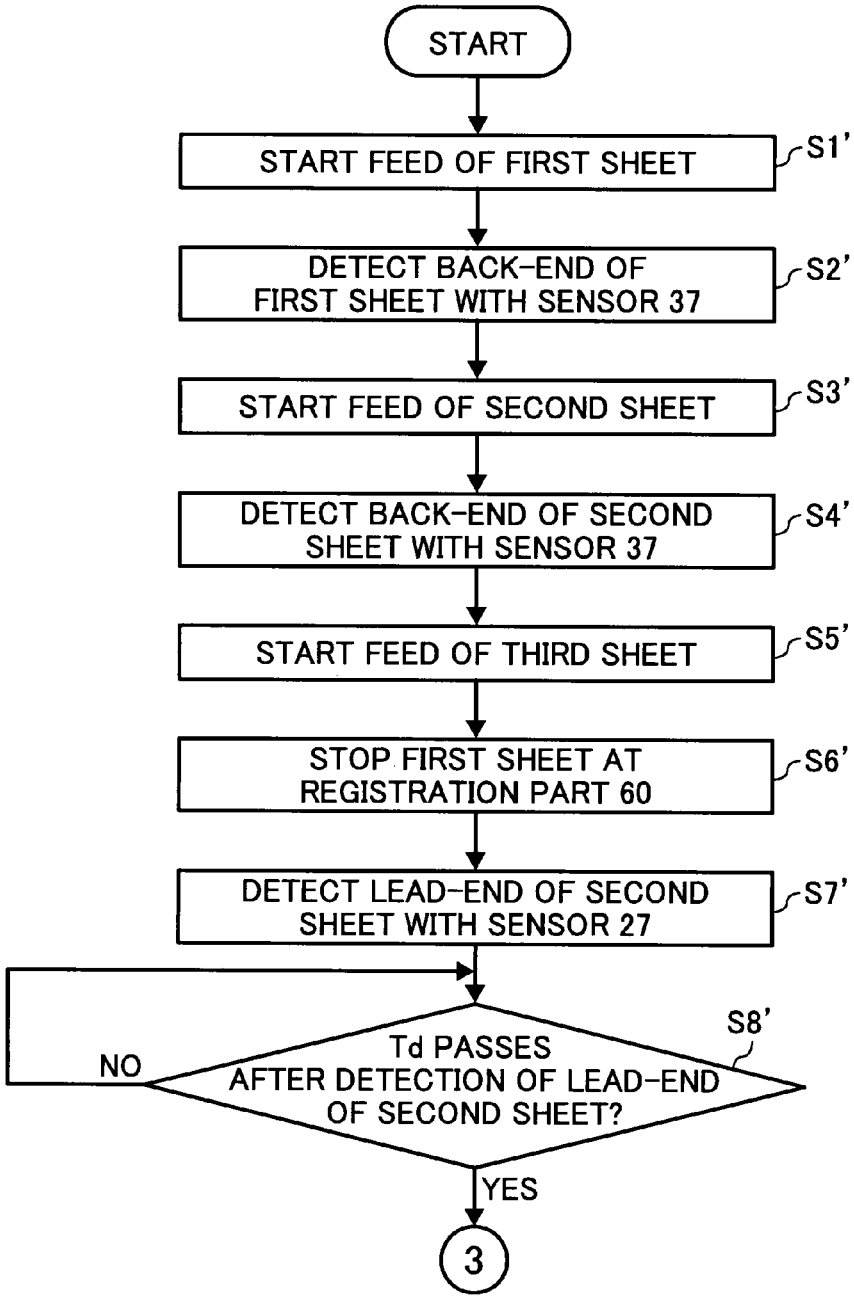
FIGS. 11A-11D are a flowchart showing another example of the control procedure of the present invention.
Figure 11B:
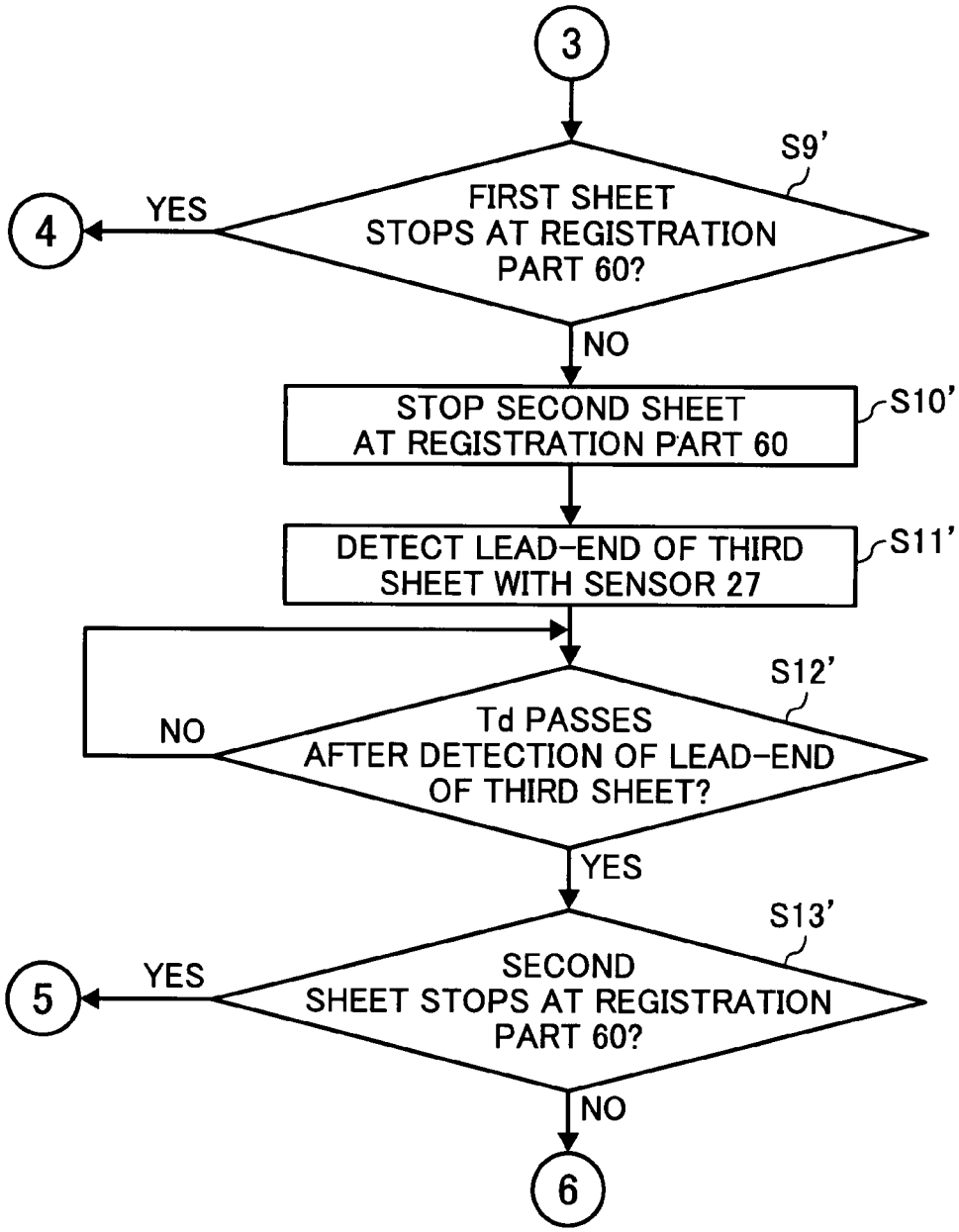
Figure 11C:
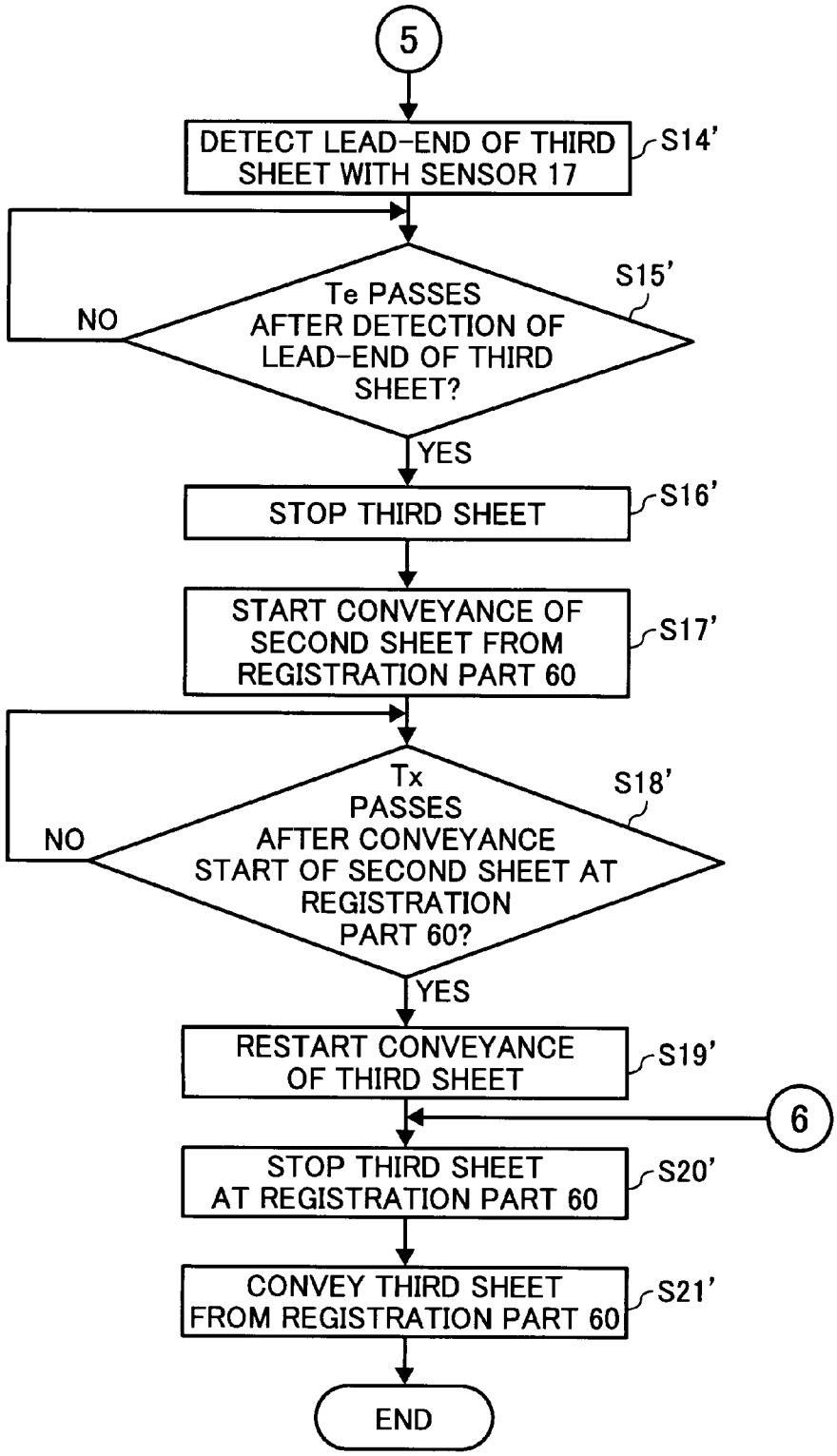
Figure 11D:
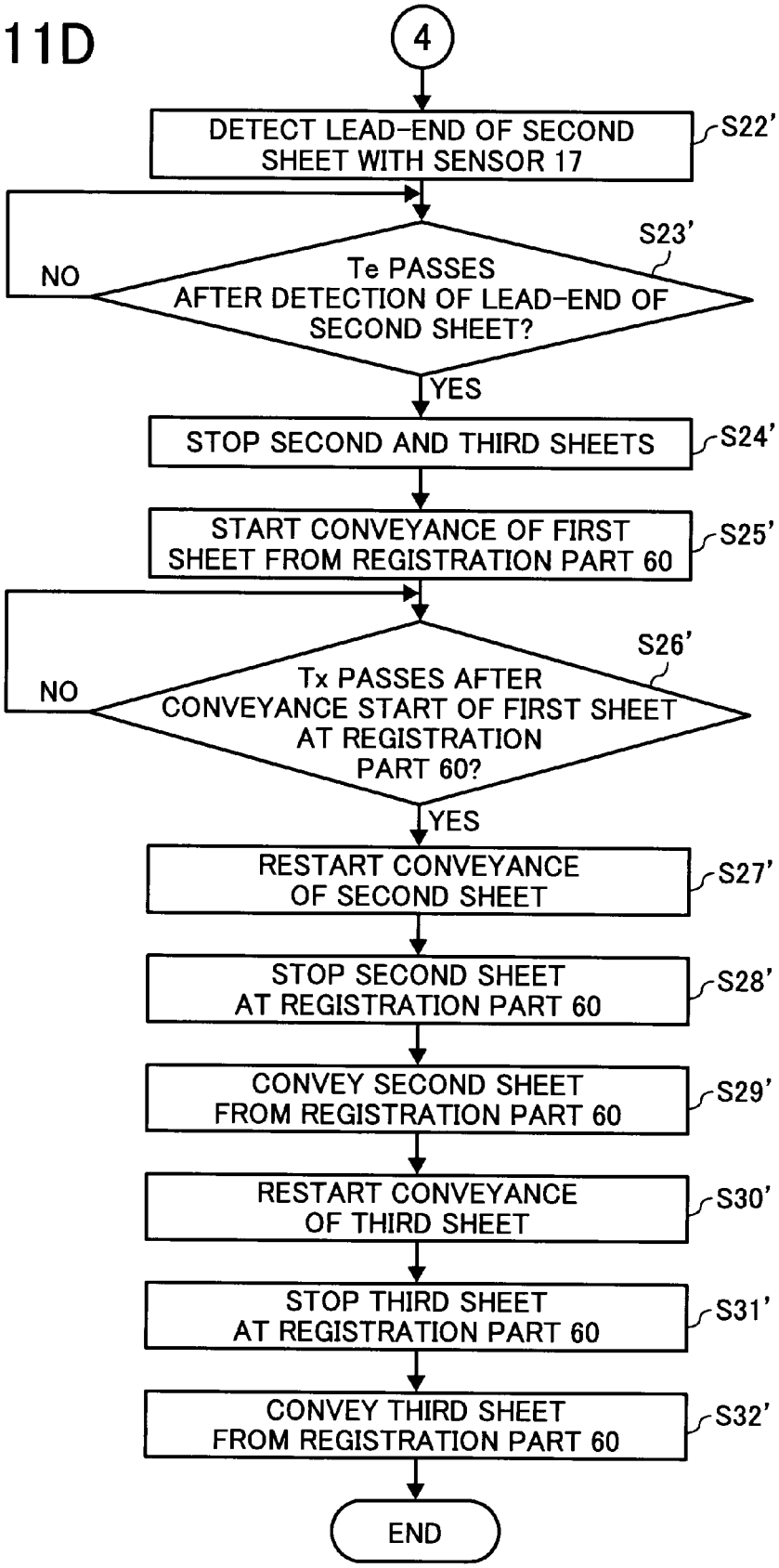

FIGS. 10A-10B show a flowchart illustrating an example of a control procedure of the present invention. The first sheet is conveyed from the feed sheet tray 1*c* (S1). The trailing end of the first sheet is detected with the conveyance sensor 37 (S2), triggering conveyance of the second sheet from the feed sheet tray 1*c* (S3). The first sheet stops at the pair of registration rollers 61 (S4). The leading end of the second sheet is detected with the conveyance sensor 37 (S5). It is determined whether a given time Td passes after the detection or not (S6). It is determined whether the first sheet stops at the registration part 60 or not (S7). If the result is No in S7, the second sheet is conveyed to the pair of registration rollers 61 without stopping, and the second sheet stops at the pair of registration rollers 61 (S14). After that, the second sheet is conveyed from the registration part 60 (S15). If the result is Yes in S7, the leading end of the second sheet is detected with the conveyance sensor 27 (S8). It is determined whether a given time Te passes after the detection or not (S9). If the given time Te passes, the conveyance of the second sheet is stopped (S10). The conveyance of the first sheet is started at the registration part 60 (S11). It is determined whether a given time Tx passes after the conveyance start of the first sheet at the registration part 60 (S12). If the given time Tx passes, the conveyance of the second sheet is restarted (S13). The second sheet is conveyed to the pair of registration rollers 61 without stopping, and the second sheet stops at the pair of registration rollers 61 (S14). After that the second sheet is conveyed from the registration part 60 (S15). The operation is repeated for the required number of sheets. This control procedure solves a problem of sheet collision and reduces an excessive decrease in productivity.

In the example 3, the restart timing of the conveyance of the second sheet when the first sheet is conveyed with the pair of registration rollers 61 is not restricted to what is described above. As described in the first embodiment, when the extension of the stop time of the first sheet that is stopped at the pair of registration rollers 61 is short (about 5 ms-50 ms), the resumption of the conveyance of the second sheet may be possible immediately after the stop of the conveyance of the second sheet in the operating range of stepping motors 222, and 232. When the extension of the stop time of the first sheet that is stopped at the pair of registration rollers 61 is longer than about 50 ms, the conveyance of the second sheet may be restarted after the given time Tx. Alternatively, the conveyance of the second sheet may be restarted a given time after the detection of the trailing end of the first sheet with the registration sensor 62. Thus, the second sheet may be conveyed to the pair of registration rollers 61 while the first sheet is conveyed from the registration part 60. Therefore, the collision of the second sheet and the first sheet is reliably prevented. By changing the restart timing of the second sheet according to the stop time of the first sheet at the pair of registration rollers 61, an excessive decrease in productivity is prevented. In addition, if an interval between the first sheet and the second sheet cannot be shortened to a given distance, the second sheet may be conveyed to the registration part 60 without stopping. Therefore, the interval may be shortened effectively to achieve high productivity. Moreover, excessive shortness of the interval between the second sheet and the first sheet stopped at the registration part 60 may be prevented.

Example 4

Three sheets are conveyed on the conveyance path in this example. The control procedure of this example is described below.

FIGS. 11A-11D show flowcharts illustrating another example of the control procedure of the present invention. The first sheet is conveyed from the feed sheet tray 1*c* (S1'). The trailing end of the first sheet is detected with the conveyance sensor 37 (S2'). This triggers a conveyance of the second sheet from the feed sheet tray 1*c* (S3'). The trailing end of the first sheet is detected with the conveyance sensor 37 (S4'). This triggers a conveyance of the third sheet from the feed sheet tray 1*c* (S5'). The first sheet stops at the pair of registration rollers 61 (S6'). The leading end of the second sheet is detected with the conveyance sensor 27 (S7'). It is determined whether a given time Td passes after the detection or not (S8'). It is determined whether the first sheet stops at the registration part 60 or not (S9'). If the result is No in S9', the second sheet is conveyed to the pair of registration rollers 61 without stopping, and the second sheet stops at the pair of registration rollers 61 (S10'). The leading end of the third sheet is detected with the conveyance sensor 27 (S11'). It is determined whether a given time Td passes after the detection or not (S12'). It is determined whether the second sheet stops at the registration part 60 or not (S13'). If the result is No in S13', the third sheet is conveyed to the pair of registration rollers 61 without stopping, and the third sheet stops at the pair of registration rollers 61 (S20'). After that, the third sheet is conveyed from the registration part 60 (S21'). If the result is Yes in S13' the leading end of the third sheet is detected with the conveyance sensor 17 (S14'). It is determined whether a given time Te passes after the detection or not (S15'). If the given time Te passes, the conveyance of the third sheet is stopped (S16'). The conveyance of the second sheet is started at the registration part 60 (S17'). It is determined whether a given time Tx passes after the conveyance start of the second sheet at the registration part 60 (S18' If the given time Tx passes, the conveyance of the third sheet is restarted (S19'). The third sheet is conveyed to the pair of registration rollers 61 without stopping, and the third sheet stops at the pair of registration rollers 61 (S20'). After that, the third sheet is conveyed from the registration part 60 (S21').

If the result is Yes in S9', the leading end of the second sheet is detected with the conveyance sensor 17 (S22'). It is determined whether a given time Te passes after the detection or not (S23'). If the given time Te passes, the conveyance of the second and the third sheet is stopped (S24'). The conveyance of the first sheet is started at the registration part 60 (S25'). It is determined whether a given time Tx passes after the conveyance start of the first sheet at the registration part 60 (S26'). If the given time Tx passes, the conveyance of the second sheet is restarted (S27'). The second sheet is conveyed to the pair of registration rollers 61 without stopping, and the second sheet stops at the pair of registration rollers 61 (S28'). After that, the second sheet is conveyed from the registration part 60 (S29'). The conveyance of the third sheet is restarted (S30'). The third sheet is conveyed to the pair of registration rollers 61 without stopping, and the third sheet stops at the pair of registration rollers 61 (S31'). After that, the third sheet is conveyed from the registration part 60 (S32'). The operation is repeated for the required number of sheets.

The collision of the second sheet and the first sheet is prevented by performing the above-described control procedure. The conveyance stop of the third sheet when it is determined that the conveyance of the second sheet is stopped prevents the collision of the second sheet and the third sheet without complicated control. Although in this example it is described that three sheets are conveyed simultaneously on the conveyance path, the operation is not restricted to the case of three sheets. Thus, when four or more sheets are conveyed, the third and the following sheets may be stopped at the conveyance stop timing of the second sheets. This control procedure also solves the sheet collision problem without complicated operation.

In the example 4, the restart timing of the conveyance of the second and the third sheet when the first sheet is conveyed with the pair of registration rollers 61 is not restricted to what is described above. As described in the first embodiment, the conveyance of the second sheet and the third sheet may be restarted simultaneously. Moreover, when the extension of the stop time of the first sheet that is stopped at the pair of registration rollers 61 is short (about 5 ms to 50 ms), the resumption of the conveyance of the second and the third sheet may be possible immediately after the stop of the conveyance of the second and the third sheet in the operating range of stepping motors 204, 212, 222, and 232. When the extension of the stop time of the first sheet that is stopped at the pair of registration rollers 61 is longer than about 50 ms, the conveyance of the second and the third sheet may be restarted a given time after the detection of the trailing end of the first sheet with the registration sensor 62. By changing the restart timing of the second and the third sheet according to the stop time of the first sheet at the pair of registration rollers 61, an excessive decrease in productivity is prevented.

In the above-described embodiments, descriptions are provided using examples in which the subject matter of the present disclosure is applied to the electrophotographic image forming apparatus. However, it is to be understood that the subject matter of the present disclosure may be applied to other image forming apparatuses such as printers, facsimiles and so forth, and also to a multi-functional image forming apparatus.

The embodiments being thus described, it should be apparent to one skilled in the art after reading this patent specification that the same may be varied in many ways. Such variations are not to be regarded as a departure from the spirit and scope of the present disclosure, and all such modifications as would be apparent to one skilled in the art are intended to be included within the scope of the following claims.

Embodiments of this disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present disclosure may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor). Thus, the storage medium or computer readable medium, is adapted to store information and is adapted to interact with a data processing facility or computer device to perform the method of any of the above-described embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as Floppy Disks (trademark), cassette tapes, and removable hard disks; media with a built-in rewriteable non-volatile memory, such as memory cards; and media with a built-in ROM, such as ROM cassettes.

Exemplary embodiments being thus described, it should be apparent after reading this patent specification that the same may be varied in many ways. Such variations are not to be regarded as a departure from the spirit and scope of the present disclosure, and all such modifications as would be apparent to one skilled in the art are intended to be included within the scope of the following claims.

What is claimed is:

1. An image forming apparatus, comprising:

a storage unit configured to store sheets of a recording medium;

a feeder configured to feed the sheets of the recording medium one by one from the storage unit;

a conveyance device configured to convey the sheets of the recording medium along a conveyance path;

a registration device configured to perform registration to the sheets of the recording medium and stop the sheets of the recording medium, located downstream from the conveyance device in a direction in which the sheets are conveyed; and a controller configured to control the feeder, the conveyance device, and the registration device such that when a first sheet of the recording medium is stopped at the registration device a second sheet of the recording medium is conveyed along the conveyance path without being stopped while the controller checks an interval between the first sheet of the recording medium and the second sheet of the recording medium, wherein the controller determines to stop the second sheet on the conveyance path when the interval is shorter than a given interval, and to convey the second sheet to the registration device without stopping when the interval is not shorter than the given interval and based on whether the first sheet of recording medium is held at the registration device, and the controller changes a stop control procedure of the conveyance device to stop the sheets of the recording medium depending on a number of the sheets of the recording medium located on the conveyance path.

2. The image forming apparatus of claim 1, wherein:

the controller determines whether the interval is shorter or is not shorter than the given interval by detecting whether the first sheet of the recording medium is located and stopped at the registration device a given time Td after detecting the second sheet of the recording medium with a given one of the plurality of the sensors; and the controller stops the second sheet of the recording medium on the conveyance path when the first sheet of the recording medium is located and stopped at the registration device the given time Td after detecting the second sheet, and conveys the second sheet of the recording medium without stopping to the registration device by the conveyance device when the first sheet of the recording medium is not stopped at the registration device the given time Td after detecting the second sheet.

3. The image forming apparatus of claim 1, wherein when the controller determines to stop the second sheet of the recording medium, the controller stops the second sheet of the recording medium on the conveyance path a given time Te after detecting the second sheet of the recording medium with a given one of the plurality of the sensors.

4. The image forming apparatus of claim 1, wherein when the controller determines to stop the second sheet of the recording medium, the controller causes the conveyance device to stop the second sheet of the recording medium on the conveyance path as fast as possible within an operating range thereof.

5. The image forming apparatus of claim 1, wherein:

when only one sheet of the recording medium is located on the conveyance path, the controller stops the only one sheet of the recording medium on the conveyance path a given time Te after detecting the sheet with a given one of the plurality of the sensors; and when a plurality of sheets of the recording medium are located on the conveyance path, the controller stops the plurality of sheets except for the first sheet of the recording medium on the conveyance path as fast as possible within an operating range of the conveyance device.

6. The image forming apparatus of claim 1, wherein, when the second sheet or subsequent sheets of the recording medium are stopped on the conveyance path, the controller changes a restart timing of the second sheet or subsequent sheets of the recording medium depending on a stop time of the first recording medium at the registration device.

7. An image forming apparatus, comprising:

a storage unit configured to store sheets of a recording medium;

a feeder configured to feed the sheets of the recording medium one by one from the storage unit;

a conveyance device configured to convey the sheets of the recording medium along a conveyance path;

a plurality of sensors configured to detect the sheets of the recording medium along the conveyance path;

a registration device configured to perform registration to the sheets of the recording medium; and a controller configured to control the feeder, the conveyance device, and the registration device such that when a first sheet of the recording medium is stopped at the registration device or before the first sheet reaches the registration device, the feeder feeds a second sheet of the recording medium to the conveyance path, check a stop time of the first sheet of the recording medium at the registration device, and determine to stop the second sheet on the conveyance path when the stop time of the first sheet of the recording medium is longer than a given time Tr, and convey the second sheet to the registration device without stopping when the stop time of the first sheet of the recording medium is not longer than the given time Tr.

8. The image forming apparatus of claim 7, wherein the controller is further configured to check an interval between the first sheet of the recording medium and the second sheet of the recording medium, determine to stop the second sheet on the conveyance path when the interval is shorter than a given interval, and convey the second sheet to the registration device without stopping when the interval is not shorter than the given interval, and determine whether the interval is shorter or is not shorter than the given interval depending on the stop time of the first sheet of the recording medium at the registration device.

9. The image forming apparatus of claim 7, wherein when the controller determines to stop the second sheet of the recording medium, the controller stops the second sheet of the recording medium on the conveyance path a given time Te after detecting the second sheet of the recording medium with a given one of the plurality of the sensors.

10. The image forming apparatus of claim 7, wherein when the controller determines to stop the second sheet of the recording medium, the controller causes the conveyance device to stop the second sheet of the recording medium on the conveyance path as fast as possible within an operating range thereof.

11. The image forming apparatus of claim 7, wherein the controller changes a stop control procedure of the conveyance device to stop the sheets of the recording medium depending on a number of the sheets of the recording medium located on the conveyance path.

12. The image forming apparatus of claim 7, wherein, when the second sheet or subsequent sheets of the recording medium are stopped or the conveyance path, the controller changes a restart timing of the second sheet or subsequent sheets of the recording medium depending on a stop time of the first recording medium at the registration device.

13. A recording medium conveyance control method, comprising the steps of:

feeding sheets of a recording medium one by one;

conveying the sheets of the recording medium to a registration device along a conveyance path;

feeding a second sheet of the recording medium to the conveyance path when a first sheet of the recording medium is stopped at the registration device or before the first sheet reaches the registration device;

checking a stop time of the first sheet of the recording medium at the registration device; and stopping the second sheet on the conveyance path when the stop time of the first sheet of the recording medium is longer than a given time Tr, and conveying the second sheet to the registration device without stopping when the stop time of the first sheet of the recording medium is not longer than the given time Tr.

14. An image forming apparatus, comprising:

a storage unit configured to store sheets of a recording medium;

a feeder configured to feed the sheets one by one from the storage unit;

a conveyance device configured to convey the sheets along a conveyance path;

a registration device configured to perform registration to the sheets and stop the sheets, located downstream from the conveyance device in a direction in which the sheets are conveyed;

a first sensor, located close to the registration device, configured to detect the sheets that stop at the registration device;

a second sensor configured to detect the sheets that pass through the conveyance path, located upstream from the first sensor in the direction in which the sheets are conveyed; and a controller configured to control the feeder, the conveyance device, and the registration device such that, when a first sheet of the recording medium is stopped at the registration device or before the first sheet reaches the registration device, the feeder feeds a second sheet of the recording medium to the conveyance path, wherein the controller estimates an interval between the first sheet and the second sheet based on detection results of the first sheet detected by the second sensor, detection results of the second sheet detected by the second sensor, and detection results of the first sheet detected by the first sensor, and determines to stop the second sheet on the conveyance path when the interval is shorter than a given interval and to convey the second sheet to the registration device without stopping when the interval is not shorter than the given interval.

15. An image forming apparatus, comprising:

a storage unit configured to store sheets of a recording medium;

a feeder configured to feed the sheets of the recording medium one by one from the storage unit;

a conveyance device configured to convey the sheets of the recording medium along a conveyance path;

a registration device configured to perform registration to the sheets of the recording medium and stop the sheets of the recording medium, located downstream from the conveyance device in a direction in which the sheets are conveyed; and a controller configured to control the feeder, the conveyance device, and the registration device such that when a first sheet of the recording medium is stopped at the registration device a second sheet of the recording medium is conveyed along to the conveyance path without being stopped while the controller checks an interval between the first sheet of the recording medium and the second sheet of the recording medium, wherein the controller determines to stop the second sheet on the conveyance path when the interval is shorter than a given interval, and to convey the second sheet to the registration device without stopping when the interval is not shorter than the given interval and based on whether the first sheet of recording medium is held at the registration device, and when the second sheet or subsequent sheets of the recording medium are stopped on the conveyance path, the controller changes a restart timing of the second sheet or subsequent sheets of the recording medium depending on a stop time of the first recording medium at the registration device.

16. The image forming apparatus of claim 15, wherein:

the controller determines whether the interval is shorter or is not shorter than the given interval by detecting whether the first sheet of the recording medium is located and stopped at the registration device a given time Td after detecting the second sheet of the recording medium with a given one of the plurality of the sensors; and the controller stops the second sheet of the recording medium on the conveyance path when the first sheet of the recording medium is located and stopped at the registration device the given time Td after detecting the second sheet, and conveys the second sheet of the recording medium without stopping to the registration device by the conveyance device when the first sheet of the recording medium is not stopped at the registration device the given time Td after detecting the second sheet.

17. The image forming apparatus of claim 15, wherein when the controller determines to stop the second sheet of the recording medium, the controller stops the second sheet of the recording medium on the conveyance path a given time Te after detecting the second sheet of the recording medium with a given one of the plurality of the sensors.

18. The image forming apparatus of claim 15, wherein when the controller determines to stop the second sheet of the recording medium, the controller causes the conveyance device to stop the second sheet of the recording medium on the conveyance path as fast as possible within an operating range thereof.

19. The image forming apparatus of claim 15, wherein:

when the stop time of the first sheet of the recording medium at the registration device is shorter than a given time, the controller restarts the second or subsequent sheets of the recording medium immediately after the stop of the second or subsequent sheets of the recording medium; and when the stop time of the first sheet of the recording medium at the registration device is not shorter than the given time, the controller restarts the second or subsequent sheets of the recording medium a given time after the registration device starts to feed the first sheet of the recording medium.

20. The image forming apparatus of claim 15, wherein the controller restarts conveyance of the second or subsequent sheets of the recording medium immediately after the stop of the second sheet or subsequent sheets of the recording medium when the stop time of the first sheet of the recording medium at the registration device is shorter than a given time, and restarts conveyance of the second sheet or subsequent sheets of the recording medium a given time after a given one of the plurality of the sensors detects a trailing end of the first sheet of the recording medium when the stop time of the first sheet of the recording medium at the registration device is not shorter than the given time.

* * * * *